US012268303B1

(12) United States Patent
Merrill

(10) Patent No.: US 12,268,303 B1
(45) Date of Patent: Apr. 8, 2025

(54) MOUNTING BRACKET

(71) Applicant: ULTRA SHELF LLC, Rigby, ID (US)

(72) Inventor: Kristopher Kent Merrill, Rigby, ID (US)

(73) Assignee: ULTRA SHELF LLC, Rigby, ID (US)

( * ) Notice: Subject to any disclaimer, the term of this patent is extended or adjusted under 35 U.S.C. 154(b) by 0 days.

(21) Appl. No.: 16/926,496

(22) Filed: Jul. 10, 2020

Related U.S. Application Data

(60) Provisional application No. 62/946,887, filed on Dec. 11, 2019, provisional application No. 62/879,328, filed on Jul. 26, 2019, provisional application No. 62/872,964, filed on Jul. 11, 2019.

(51) Int. Cl.
*A47B 96/02* (2006.01)
*A47B 96/06* (2006.01)

(52) U.S. Cl.
CPC ..... *A47B 96/028* (2013.01); *A47B 96/066* (2013.01)

(58) Field of Classification Search
CPC ..... A47B 96/066; A47B 96/028
USPC ..... 108/108; 248/239, 247, 248
See application file for complete search history.

(56) References Cited

U.S. PATENT DOCUMENTS 617,164 A * 1/1899 Name not available ..... A47B 96/061 248/248
1,901,235 A * 3/1933 Glowacki ..... F21V 21/03 362/404
3,596,942 A * 8/1971 Zoebelein ..... F16B 12/22 403/230
4,189,123 A * 2/1980 Johnson ..... A47B 57/42 108/108
4,398,647 A * 8/1983 Ackerman ..... H01R 25/165 439/573
4,460,147 A * 7/1984 Macbain ..... F16B 12/22 248/222.41
4,569,458 A * 2/1986 Horsley ..... H02G 3/125 220/3.9
4,793,267 A * 12/1988 Birillo ..... A47B 96/028 108/108
5,417,401 A * 5/1995 Thompson ..... F24F 1/027 248/300
5,779,380 A * 7/1998 Knapp ..... A47B 87/008 403/329
6,164,610 A * 12/2000 Santiago ..... A47B 96/022 211/90.01
6,357,716 B1 * 3/2002 Kratish ..... A47G 1/205 248/466
6,569,244 B1 * 5/2003 Jenkins ..... B05C 5/0254 118/302

(Continued)

FOREIGN PATENT DOCUMENTS

CN 111150247 A * 5/2020 ..... A47B 96/061
WO WO-9302594 A1 * 2/1993 ..... A47B 96/02

*Primary Examiner* — Daniel J Troy
*Assistant Examiner* — Timothy M Ayres
(74) *Attorney, Agent, or Firm* — HOLLAND & HART LLP

(57) ABSTRACT

A bracket for mounting a shelf to a surface, the bracket comprising: a first face for placement against the surface, a second face for placement against the shelf, the second face further including a shelf attachment, and an edge between the first and second faces, wherein the bracket further includes at least one hole between the first and second faces, the hole being continuous with the edge.

17 Claims, 9 Drawing Sheets

(56) References Cited

U.S. PATENT DOCUMENTS

| | | | | |
|---|---|---|---|---|
| 7,708,252 | B2 * | 5/2010 | Vander Berg | A47B 96/061 248/544 |
| 7,984,888 | B2 * | 7/2011 | Park | F16M 11/10 248/281.11 |
| 8,011,160 | B2 * | 9/2011 | Rice | E04B 2/7457 52/745.09 |
| 9,185,979 | B1 * | 11/2015 | Jenks | A47B 96/066 |
| 10,088,094 | B2 * | 10/2018 | Craig | B62B 5/00 |
| 10,107,419 | B2 * | 10/2018 | Anderson | F16L 3/14 |
| 10,412,929 | B2 * | 9/2019 | Kasper | A01K 7/005 |
| 10,687,623 | B1 * | 6/2020 | Mello | A47B 96/068 |
| 2007/0125738 | A1 * | 6/2007 | Sevack | A47B 96/066 211/187 |
| 2007/0252056 | A1 * | 11/2007 | Novin | F16M 11/12 248/205.1 |
| 2008/0237434 | A1 * | 10/2008 | Lin | F16M 13/02 248/497 |
| 2011/0024591 | A1 * | 2/2011 | Gordon | E06B 1/6015 248/222.14 |
| 2017/0208774 | A1 * | 7/2017 | Kasper | A01K 7/005 |
| 2018/0125238 | A1 * | 5/2018 | Anderson | A47B 96/028 |
| 2019/0053623 | A1 * | 2/2019 | Sisto | F16B 5/0084 |

* cited by examiner

MOUNTING BRACKET

INTRODUCTION

The following relates generally to brackets, such as mounting brackets. In some versions, the following relates specifically to brackets for mounting shelves and/or furniture.

SUMMARY

The present invention provides brackets for connecting (permanently or removably) items including shelves and/or furniture to surfaces such as walls to support them during use. In some instances, the disclosure provides a floating shelf bracket which may be attached to a surface (e.g., a wall) to support a shelf. The bracket may comprise a first face for placement against the surface and a second face for placement against the shelf, the second face further including a shelf attachment and an edge between the first and second faces. The bracket further includes at least one hole between the first and second faces, the hole being continuous with the edge of the bracket. In some instances, the at least one hole may be a plurality of holes. The at least one hole may be continuous with the edge of the bracket via a channel. The channel may have a width similar or identical to the diameter of the at least one hole. In other embodiments, the channel may have a width smaller than the diameter of the at least one hole.

In some examples, the plurality of holes may be uniformly spaced apart from each other along the edge of the bracket. The plurality of holes may also be irregularly spaced apart from each other along the edge of the bracket. Further, holes may be placed both regularly and irregularly along the edge of the bracket. The edge of the bracket may refer to any edge of the bracket. In some instances, the edge of the bracket is a top edge of the bracket. In others, the edge of the bracket may be a bottom edge of the bracket. In some instances, the hole or plurality of holes may be found on at least one edge of the bracket, including more than one or all edges of the bracket.

The hole or holes of the bracket may have a regular or irregular shape. In some instances, that shape may be a geometric shape independently selected from the group consisting of circle, ellipse, hexagon, rounded hexagon, triangle, trapezoid, rounded triangle, rectangle, rounded rectangle, square, rounded square, and cross-shaped. In some cases, the at least one hole may have a diameter at the first face that is the same as at the second face. In others, the at least one hole may have a diameter at the second face that is wider than a diameter at the first face. In still others, the at least one hole may have a diameter that is wider at the first face than a diameter at the second face.

In some examples, the shelf attachment may comprise a plurality of rods extending from the second face of the bracket to support the shelf. The plurality of rods may be perpendicular to the front face of the bracket. In some instances, the rod shape may be a geometric shape independently selected from the group consisting of circle, ellipse, hexagon, rounded hexagon, triangle, rounded triangle, trapezoid, rectangle, rounded rectangle, square, rounded square, and cross-shaped. In other instances, threaded rod, flat bar, or rebar type materials may also be used. In yet other instances, the first face and second face could have holes for a screw, nail, bolt, etc. to mount the first face or second face of the bracket directly to the shelf.

In some examples, the bracket may have a plurality of holes between the first face and second face, configured for mounting the bracket to the surface, wherein the plurality of holes is continuous along a top edge. A plurality of rods may extend from the second face of the bracket to support the shelf. The plurality of holes may be continuous along the top edge of the bracket, and continuous along a bottom edge of the bracket. The plurality of holes may be spaced along the top edge and optionally along a bottom edge of the bracket to accommodate the spacing of wall studs.

In some examples, the bracket may have plurality of holes cut into the bracket using a single cut by a cutting device. In some of these, the bracket may be cut, along with its plurality of holes, without lifting a cutting device such as a CNC metal cutting device. The bracket may include at least one hole continuous with a lower edge of the bracket, also cut into the edge of bracket using a single cut along the edge of the bracket.

In some cases, the bracket may be adapted to support furniture. The bracket may include a furniture attachment. In some instances, the furniture attachment may include an upward-facing, perpendicular, j-shaped, or multi angular lip attached to the second face of the bracket to support the article of furniture. The second face of the bracket may be bent in a j-shaped lip to support the article of furniture.

DETAILED DESCRIPTION

Figure 1:
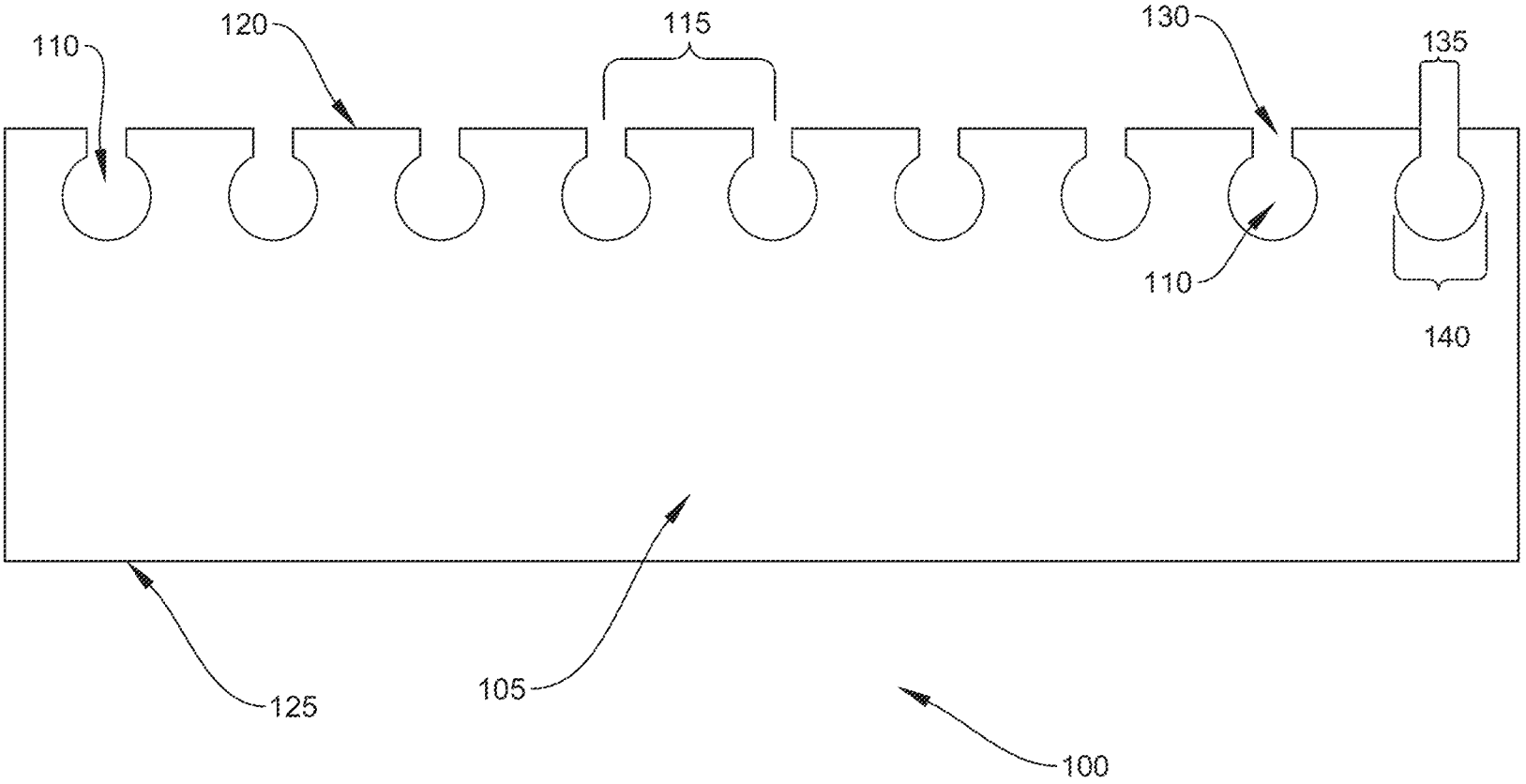
FIG. 1 is a schematic illustration of a portion of a mounting bracket in accordance with one or more aspects of the present disclosure.

Examples of a bracket for mounting items to a surface are described herein. The bracket may be made from a strong, durable material to support the weight of a shelf and/or furniture. In some instances, the bracket may be made from a sheet material (e.g., metal). The sheet material may be, or may be shaped to be rectangular in shape and flat to allow the bracket to be placed against a flat surface. In some instances, the bracket may conform at least partially to the shape of the surface. To form the brackets of the invention, holes may be cut into the sheet material. The holes may have any geometric shape (e.g., circle, ellipse, hexagon, rounded hexagon, triangle, rounded triangle, trapezoid, rectangle, rounded rectangle, square, rounded square, and cross-shaped, etc.). In some cases, the holes may be drilled into the sheet material.

In other cases, the holes may be cut into the sheet material. The holes may be cut into the sheet material using a continuous cut in which a machine (e.g., CNC) cuts along the edge of the sheet material, cuts out the hole and continues cutting along the edge and the next hole. The machine may make the continuous cut without ever lifting the cutting tool (e.g., laser or plasma tool) from the sheet material. In some instances that cut may form at least a portion of an edge of the brackets of the disclosure. In others, the cut may form a complete edge of the bracket, or may be continuous along multiple edges of the bracket. The continuous cut may be interrupted at any point, such as by starting and stopping the tool, or by doing a partial cut at one point, moving to another point, and then returning to the first partial cut to complete it, completing the continuous cut described.

In others, the profile of the cuts, i.e., the profile of the holes provided along the edge of the sheet material, is continuous. To form this continuous profile, a single cut may be used, as described above. Alternatively, the continuous profile may be made by interrupting the cut, such as by lifting/removing/stopping operation of the tool, such as a CNC tool, and then resuming the cut either in the same place, or along a new edge of the sheet material. The continuous profile may be created using multiple, interrupted (such as by multiple starts and stops), or discontinuous cuts by a machine such as a CNC machine.

In some examples, a continuous cut may include taking a sheet material (e.g., dimensions of 3 ft×8 ft, 3 ft×10 ft, 3 ft×12 ft, 4 ft×8 ft, 4 ft×10 ft, 4 ft×12 ft, 5 ft×8 ft, 5 ft×10 ft, 5 ft×12 ft or any size consisting of partially cut, or uncut sheets or strap of sizes from 0.5 inches to 240 inches×0.5 inches to 240 inches), cutting it into strips (e.g., dimensions of 0.5 inches to 7.5 inches), and cut out the holes into the strip as the machine cuts the strip out of the sheet material. In some examples, making the brackets using a continuous cut pattern may keep the strip from bowing due to heat.

The holes may be shaped to have an open top on the edge of the sheet material. In some instances, the open top is simply a discontinuity in the shape of the hole where it is cut continuous with the edge of the strip. In others, the open top may resemble a channel between the edge of the strip and the hole. The open top diameter (e.g., 0.015 inches to 1.625 inches) may be narrower than the hole diameter (e.g., 0.015 inches to 1.625 inches) itself to prevent a fastener (e.g., screw, nail, bolt, etc.) from sliding out of the hole. The back of the screws may have a deep taper with the screw head diameter (e.g., ⅜ inch) larger than the hole diameter (e.g., ¼ inch). The deep taper of the screw may center within the hole to pull the bracket tight against the wall when fastened.

The hole or holes may be produced to have a constant diameter between the first and second faces of the bracket. Alternatively, the hole or holes may have a diameter at the second face that is wider than a diameter at the first face. This may assist in receiving the taper of the screw within the hole and to assist in pulling the bracket tight against the wall, while allowing a screw to seat within the bracket smoothly to allow a tight fit of a shelf against the bracket. In still other embodiments, the at least one hole may have a diameter that is wider at the first face than a diameter at the second face.

In some examples, the holes may be cut along the top edge or bottom edge of the bracket or a combination therein. In some cases, holes may be cut along a side edge or edges as well. The holes may be spaced apart in a uniform or non-uniform pattern. In some cases, the holes may be spaced in a continuous pattern along the edge of the bracket. In other cases, the holes may be spaced in a discontinuous pattern along the edge of the bracket. The discontinuous holes may include several holes (e.g., 4-6 holes) spaced apart and a gap of several inches of no holes followed by more holes. The holes in the bracket may be spaced to accommodate the spacing of wall studs. The holes may be repetitive so the bracket can be attached at any part to the wall and have holes align with wall studs.

The bracket may be configured for mounting a shelf on a surface (e.g., wall) using a variety of shelf mounts. Rods may be attached to the sheet material to form the bracket and a shelf may slide onto the rods. The rods may be of any geometric shape and uniformly or non-uniformly spaced on the sheet material. The rods may be attached to the sheet material at a perpendicular angle, so the shelf is at least substantially flat. The rods may also be attached to the sheet material at any angle. The shelf may be positioned to hide the bracket behind the shelf, causing the shelf to appear to be floating on the wall. The holes may be spaced apart in a close, repetitive, manner to allow the bracket to be attached to any studs in the wall. The thickness of the bracket and the type, number, thickness of the shelf mounts may be decreased for size and/or proposed capacity and/or increased to allow the shelf to support a higher weight capacity.

The bracket may be configured for mounting furniture to a surface. In some examples, an upward-curling lip may be attached to the sheet material to form a bracket and an item of furniture my hook onto the upward curling lip. The upward curling lip may be at any angle to allow an item of furniture to hang from the bracket on a surface. The thickness of the bracket may be increased to allow the furniture to support a higher weight capacity. The furniture bracket may add to home safety by increasing stability of furniture along walls. Mounting furniture to a wall may reduce the possibility of furniture falling onto children trying to climb on the furniture or during earthquakes.

FIG. 1 is a schematic illustration of mounting bracket system 100. The mounting bracket system 100 may include a sheet material 105 (e.g., metal) with holes 110. The holes 110 may be spaced apart 115 across the top edge 120 of the sheet material 105. The holes 110 may also be spaced apart 115 along the bottom edge 125 of the sheet material 105. The spacing 115 may be uniform (e.g., 1 inch spacing between each hole) or not uniform. The spacing 115 may also be continuous or discontinuous. The holes 110 may have a channel 130 above the hole 110 along top edge 120 of the bracket. The channel 130 may have a channel diameter 135 which is narrower than the hole diameter 140, or in some cases identical or nearly identical to the channel diameter. The narrower channel diameter 135 may prevent a fastener inserted into hole 110 from sliding out of the hole 110. In some examples, the channel 130 may have a channel diameter 135 which is wider than the hole diameter 140. A machine may cut out the channel 130 and hole 110 in a continuous cutting movement as the machine cuts along the top edge 120 or bottom edge 125 of the sheet material 105.

The bracket may have a channel 130 which has the same diameter size as the hole 110.

Figure 2:
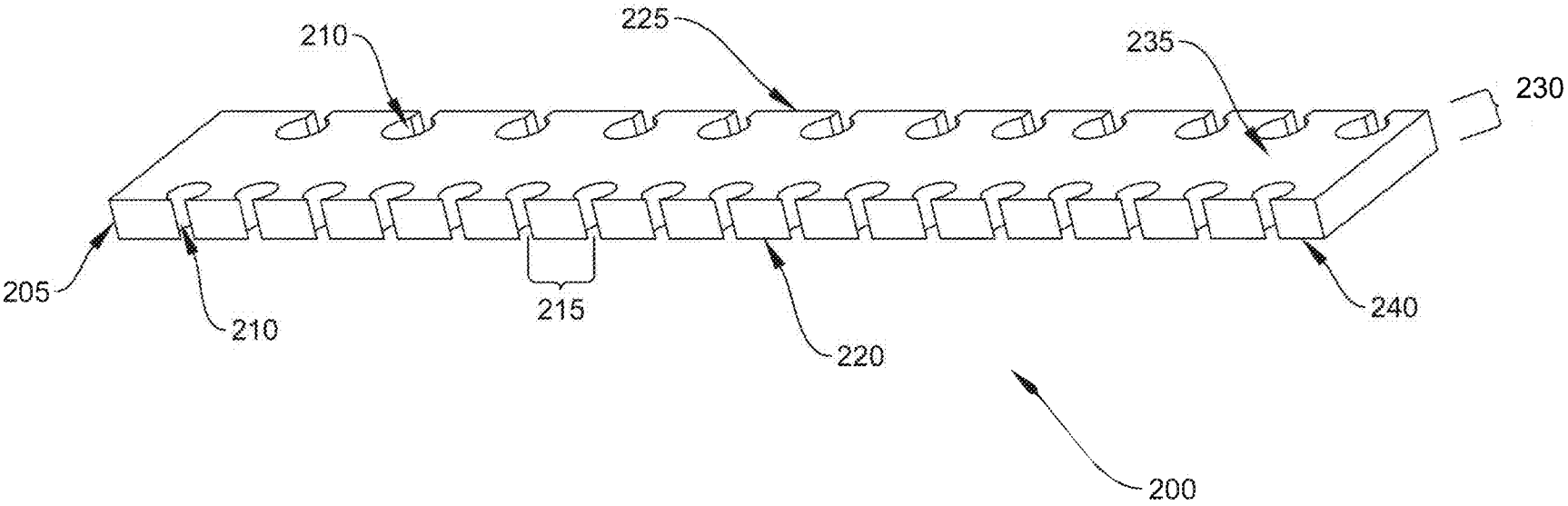
FIG. 2 is a schematic illustration of a portion of a mounting bracket in accordance with one or more aspects of the present disclosure.

FIG. 2 is a schematic illustration of mounting bracket system 200. The mounting bracket system 200 may include a sheet material 205 with holes 210. The holes 210 may be spaced apart 215 across the top edge 220 and bottom edge 225 of the sheet material 205. In some cases, holes may be cut along a side edge or edges as well. The thickness 230 of the sheet material 205 may vary depending on the weight capacity requirement bracket has to support. The sheet material may have a front face 235 and a rear face 240. The holes 210 may extend from the front face 235 to the rear face 240. The hole diameter at the front face 235 may be the same size diameter as rear face 240, or it may be varied as described above. The hole diameter at the front face 235 may wider size diameter than the rear face 240.

Figure 3:
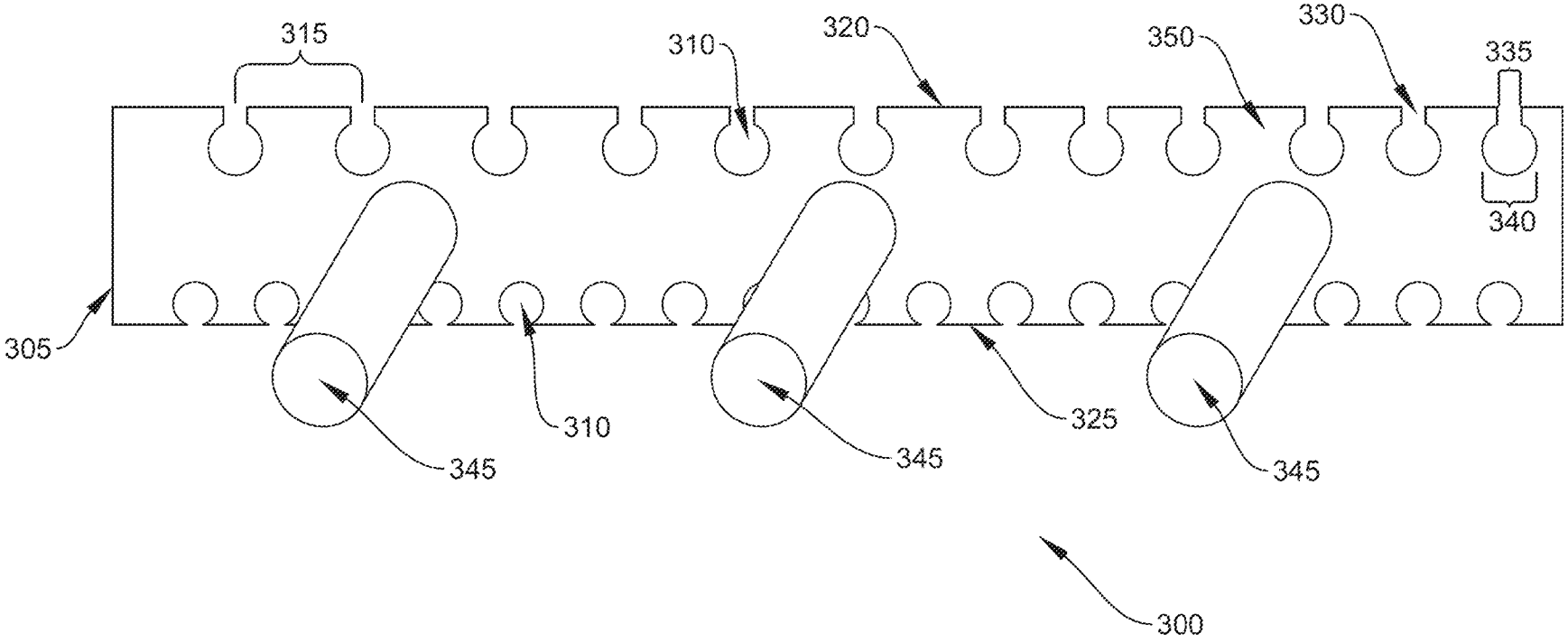
FIG. 3 is a schematic illustration of a mounting bracket in accordance with one or more aspects of the present disclosure.

FIG. 3 is a schematic illustration of mounting bracket system 300. The mounting bracket system 300 may include a sheet material 305 with holes 310. The holes 310 may be spaced apart 315 across the top edge 320 and bottom edge 325 of the sheet material 305. Rods 345 may be attached (e.g., welded or any other suitable means of attachment) to the front face 350 of the sheet material 305. The rods 345 may be welded at least substantially perpendicular to the front face 350 of the sheet material 305. There may be any number of rods 345 at any length to support the desired weight capacity for the shelf. The shape of the rods 345 may be any geometric shape. The holes 310 may have a channel 330 above the hole 310 along top edge 320 of the bracket. The channel 330 may have a channel diameter 335 which is narrower than the hole diameter 340. The narrower channel diameter 335 may prevent a fastener inserted into hole 310 from sliding out of the hole 310. A machine may cut out the channel 330 and hole 310 in a continuous cutting movement as the machine cuts along the top edge 320 or bottom edge 325 of the sheet material 305.

FIGS. 4A, 4B, 4C, and 4D are schematic illustrations of mounting bracket systems 400-*a*, 400-*b*, 400-*c* and 400-*d*. The mounting bracket system may include a sheet material 105 with holes 110. The holes 110 may be spaced apart 115 across the top edge 120 and bottom edge 125 of the sheet material 105. The holes 110 may be of any shape. Mounting bracket systems 400-*a* illustrates circle holes 110-*a* which may be drilled into the sheet material 105 or cut into the sheet material with a continuous cut. Mounting bracket systems 400-*b* illustrates square shaped holes 110-*b*. Mounting bracket systems 400-*c* illustrates slit holes 110-*c*. Mounting bracket systems 400-*d* illustrates triangle holes 110-*d* and trapezoid holes 110-*e*.

Figure 4A:
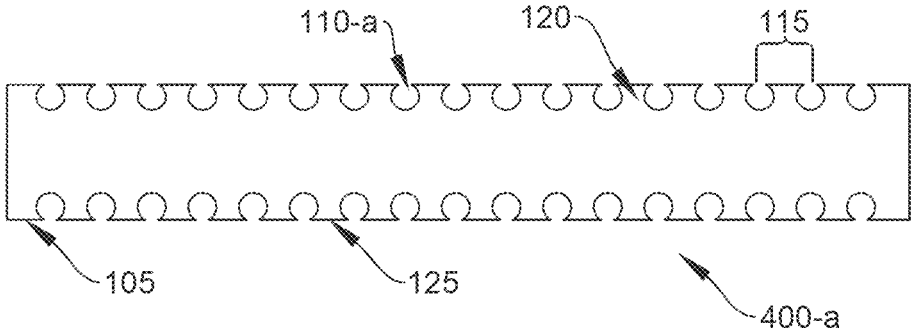
FIGS. 4A, 4B, 4C, and 4D are schematic illustrations of a portion of a mounting bracket in accordance with one or more aspects of the present disclosure.
Figure 4B:
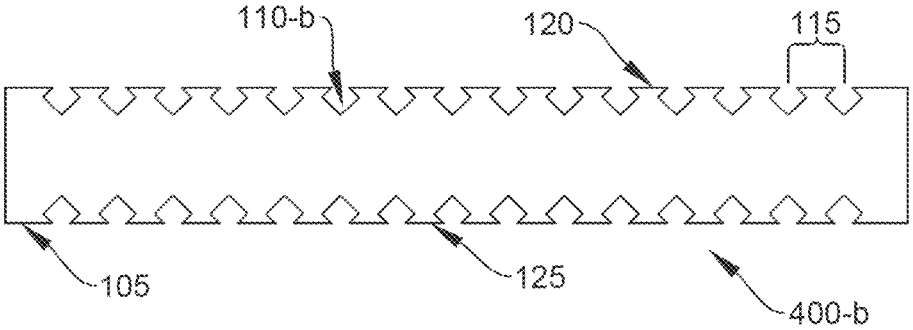
Figure 4C:
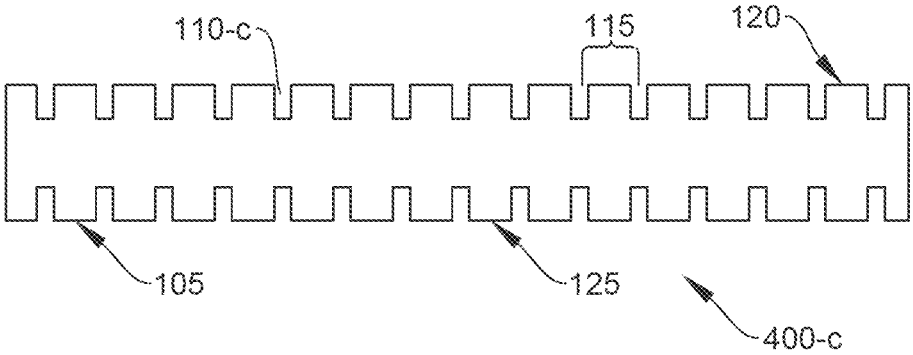
Figure 4D:
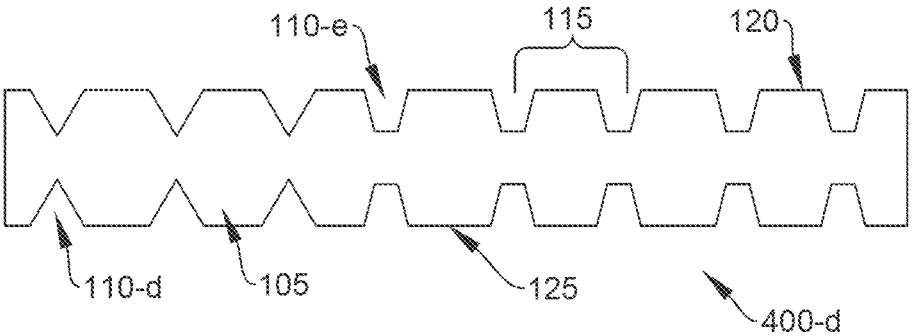

FIG. 4D shows a bracket with triangular and trapezoidal holes 110*e*. Such holes may be used together or in the alternative. On such brackets, the holes 110*e* along a top edge 120 may operate to retain the bracket against a vertical surface to which the bracket is mounted, while holes 110*e* along a bottom edge 125 support the bracket vertically. In these and all other brackets of the disclosure, the size of the hole and/or channel may be varied to accommodate a wide variety of fasteners known to one of skill in the art, including screws, nails, bolts, etc.

Figure 5:
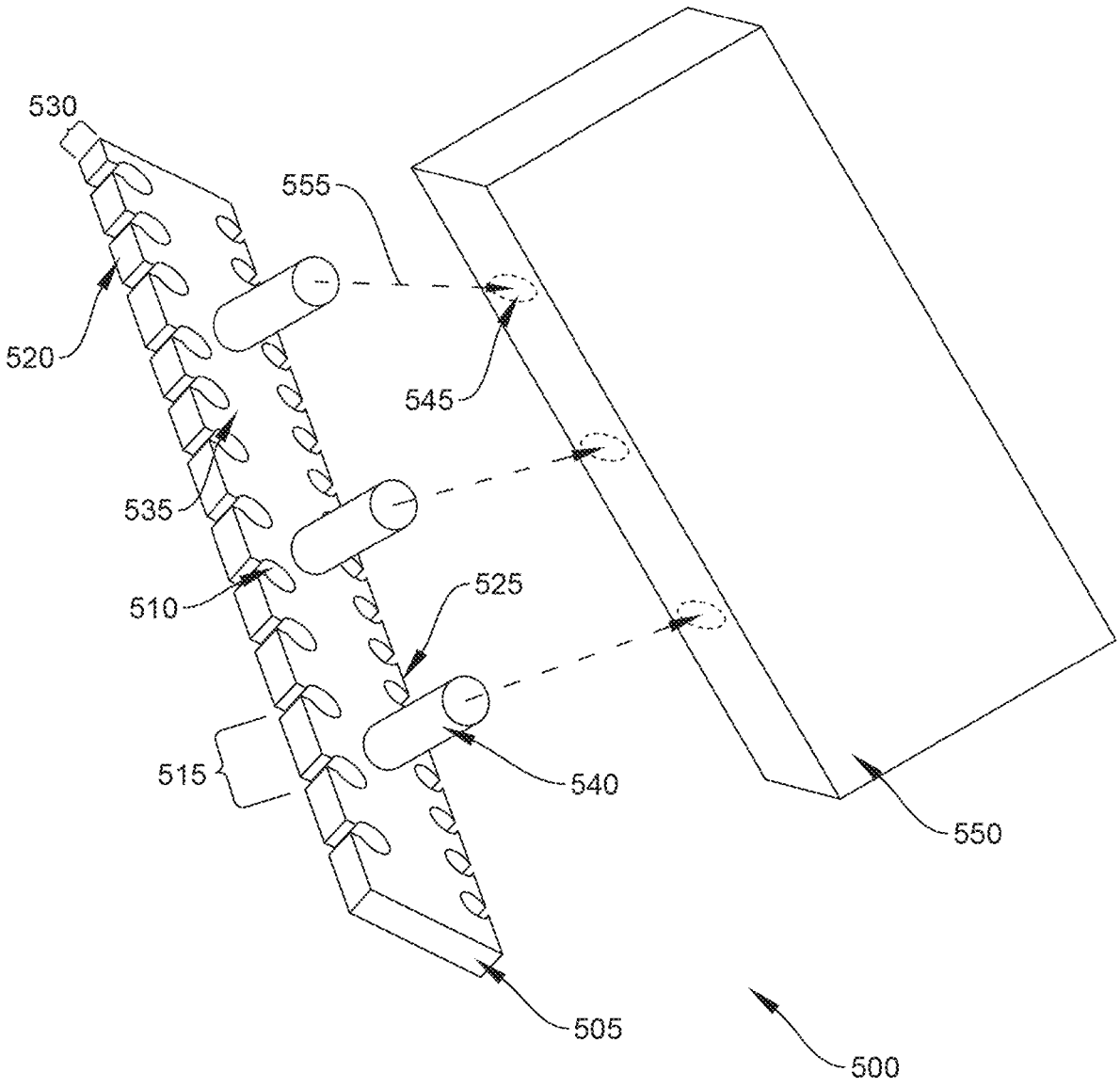
FIG. 5 is a schematic illustration of a portion of a mounting bracket and shelf in accordance with one or more aspects of the present disclosure.

FIG. 5 is a schematic illustration of mounting bracket system 500 and a shelf 550. The mounting bracket system 500 may include a sheet material 505 with holes 510. The holes 510 may be spaced apart 515 across the top edge 520 and bottom edge 525 of the sheet material 505. Rods 540 may be attached (e.g., welded) to the front face 535 of the sheet material 505. The rods 540 may be welded perpendicular to the front face 535 of the sheet material 505. There may be any number of rods 540 at any length to support the desired weight capacity for the shelf 505. The shape of the rods 540 may be any geometric shape. The rods 540 may be inserted into the shelf holes 545 of the shelf 550 as shown by direction arrows 555. The thickness 530 of the sheet material 505 may vary depending on the weight capacity requirement bracket has to support.

Figure 6:
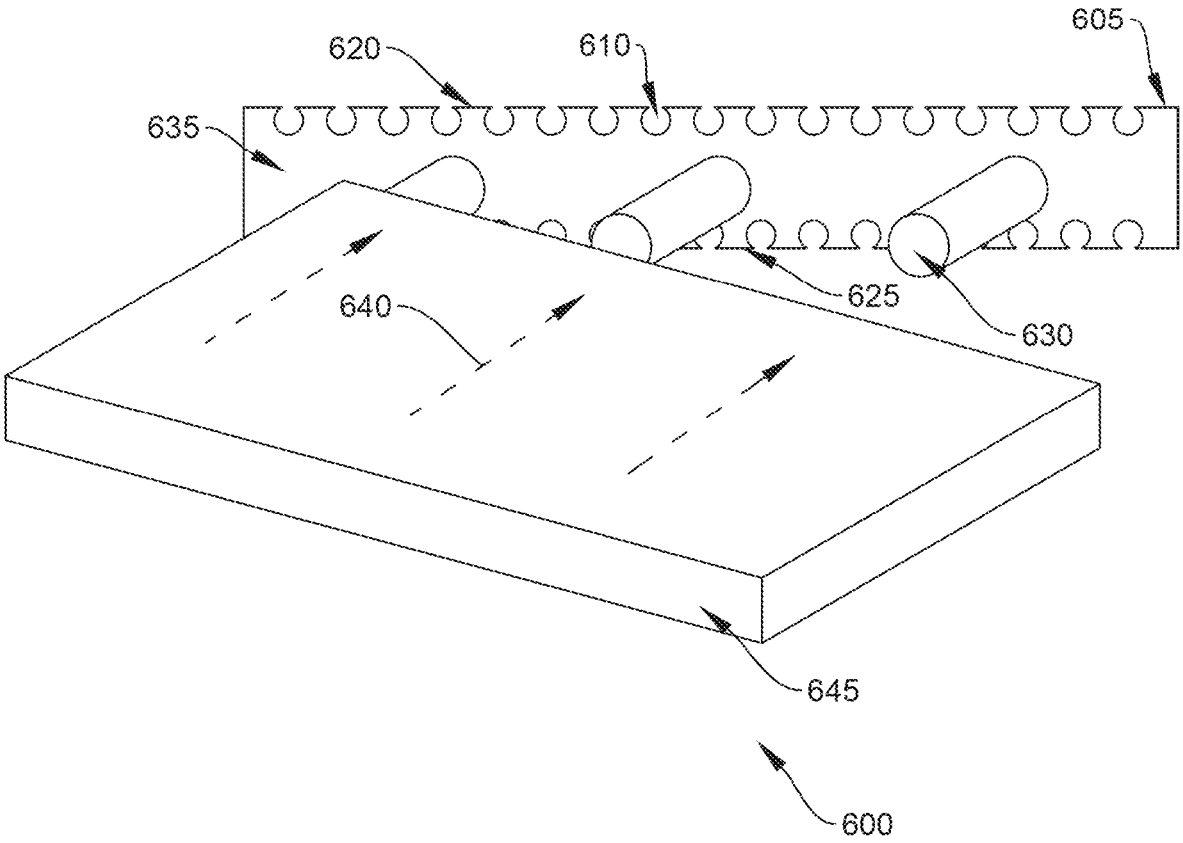
FIG. 6 is a schematic illustration of a portion of a mounting bracket and shelf in accordance with one or more aspects of the present disclosure.

FIG. 6 is a schematic illustration of a mounting bracket system 600 and a shelf 505. The mounting bracket system 600 may include a sheet material 605 with holes 610. The holes 610 may be across the top edge 620 and bottom edge 625 of the sheet material 605. Rods 630 may be attached to the front face 635 of the sheet material 605. The rods 630 may be welded perpendicular to the front face 635 of the sheet material 605. There may be any number of rods 630 at any length to support the desired weight capacity for the shelf 645. The shape of the rods 630 may be any geometric shape. The rods 630 may be inserted into the shelf holes of the shelf 645 as shown by direction arrows 640.

Figure 7:
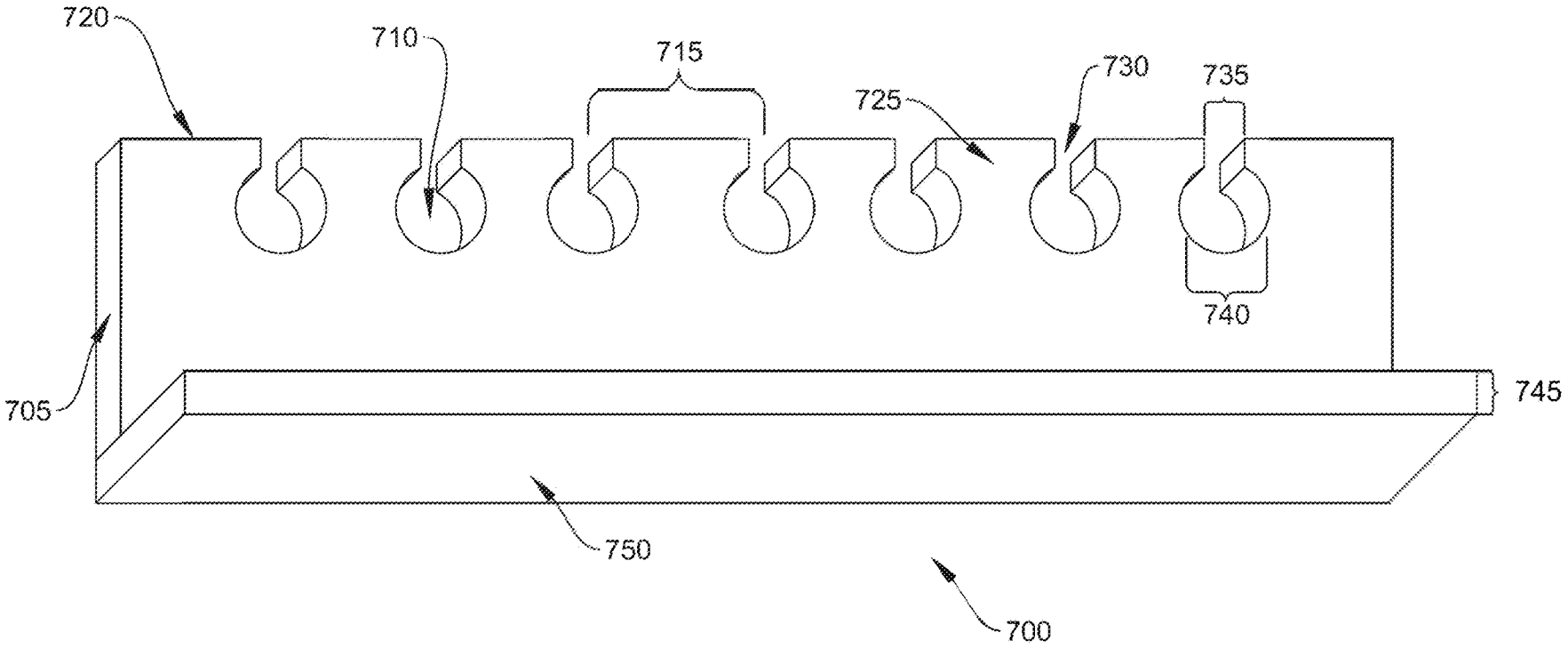
FIG. 7 is a schematic illustration of a portion of a mounting bracket in accordance with one or more aspects of the present disclosure.

FIG. 7 is a schematic illustration of mounting bracket system 700. The mounting bracket system 700 may include a sheet material 705 with holes 710. The holes 710 may be spaced apart 715 across the top edge 720 of the sheet material 705. An upward curling lip 750 may be attached to the front face 725 of the sheet material 705. The upward curling lip 750 may be welded perpendicular or an angle greater than perpendicular to the front face 725 of the sheet material 705. The upward curling lip 750 may be any thickness 745 to support the desired weight capacity for any items of furniture which may suspend from the bracket. The holes 710 may have a channel 730 above the hole 710 along top edge 720 of the bracket. The channel 730 may have a channel diameter 735 which is narrower than the hole diameter 740. The narrower channel diameter 735 may prevent a fastener inserted into hole 710 from sliding out of the hole 710. A machine may cut out the channel 730 and hole 710 in a continuous cutting movement as the machine cuts along the top edge 720 of the sheet material 705.

Figure 8A:
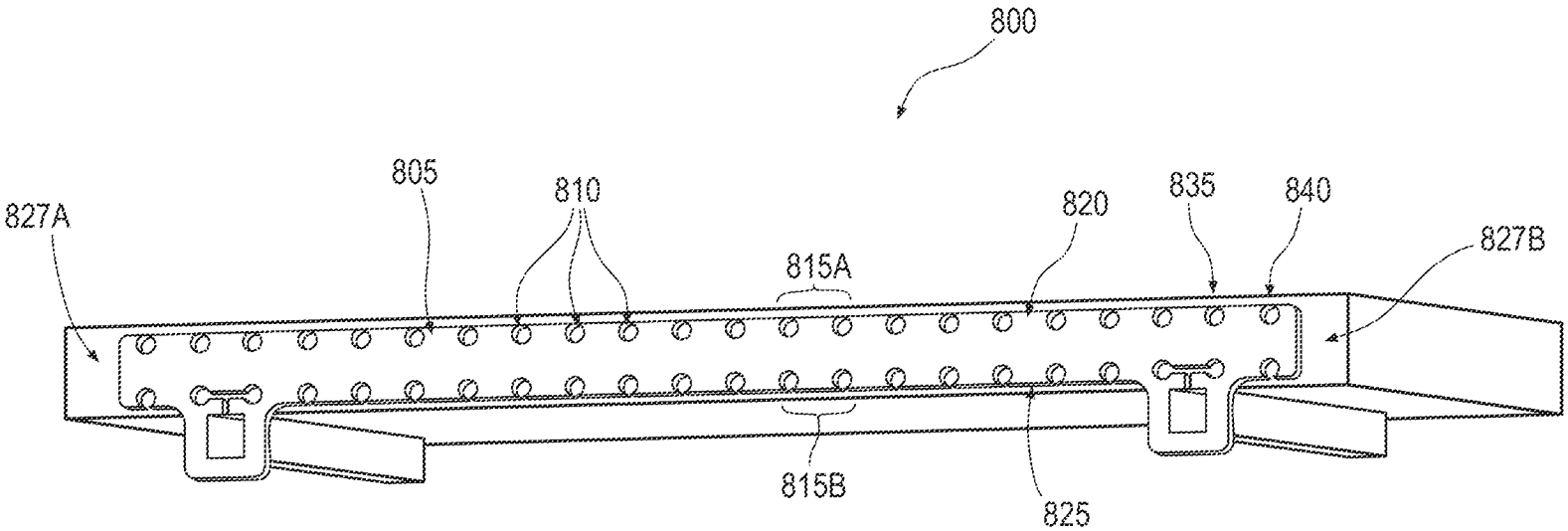
FIG. 8A is a perspective view of a mounting bracket and shelf system in accordance with one or more aspects of the present disclosure.

FIG. 8A is a schematic illustration of mounting bracket system 800. Mounting bracket system 800 may include a sheet material 805 (e.g., metal) with holes 810. The holes 810 may be spaced apart 815A across the top edge 820 of the sheet material 805. The holes 810 may also be spaced apart 815B along the bottom edge 825 of the sheet material 805. The spacing 815A, 815B may be uniform (e.g., 1 inch spacing between each hole) or not uniform. Further, spacing 815A and 815B may be identical or may differ from each other. The spacing 815A and 815B may also be continuous or discontinuous. The holes 810 may be continuous with the edge, such as the top edge 820 or the bottom edge 825 of the sheet material 805 such that the holes are open along the edge 820 or 825, as shown in FIG. 8A.

Alternatively, the holes 810 may have a channel above the hole 810 along top edge 820 of the bracket similar to those described above, i.e., in FIG. 1, in that it may have a channel with a channel diameter 835 which is narrower than the hole diameter 840, or in some cases identical or nearly identical to the channel diameter 835. The narrower channel diameter 835 may prevent a fastener inserted into hole 810 from sliding out of the hole 810. In some examples, the channel 830 may have a channel diameter 835 which is wider than the hole diameter 840. A machine may cut out the channel and hole 810 in a continuous cutting movement as the machine cuts along the edges, such as the top edge 820, bottom edge 825, or side edges 827A, 827B of the sheet material 805. The bracket may have a channel 830 which has the same diameter size as the hole 810.

Figure 8B:
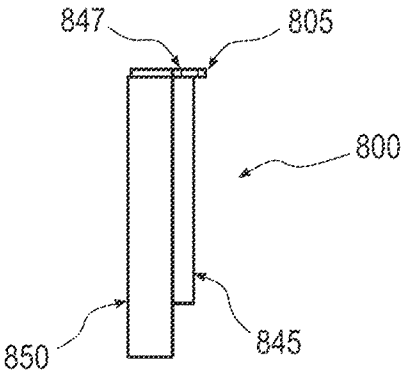
FIG. 8B is a side plan view of the mounting bracket and shelf system of FIG. 8A.

In FIG. 8B, bracket system 800 is shown in a side view to include rods 845 attached to rod mounts 847. Rods 845 may be attached (e.g., welded or any other suitable means of attachment) to face (front, back, or edge) of the sheet material 805. The rods 845 may be welded at least substantially perpendicular to the sheet material 805. There may be any number of rods 845 at any length to support the desired weight capacity for the shelf 850. The shape of the rods 845 may be any geometric shape. In FIGS. 8A-8E, rods 845 extend from the rod mounts 847 to support a shelf 850, which rests on rods 845. In some embodiments, rods 845 are substantially round in shape. In others, as shown in FIGS. 8A-8E, rods 845 are substantially square in shape.

Figure 8C:
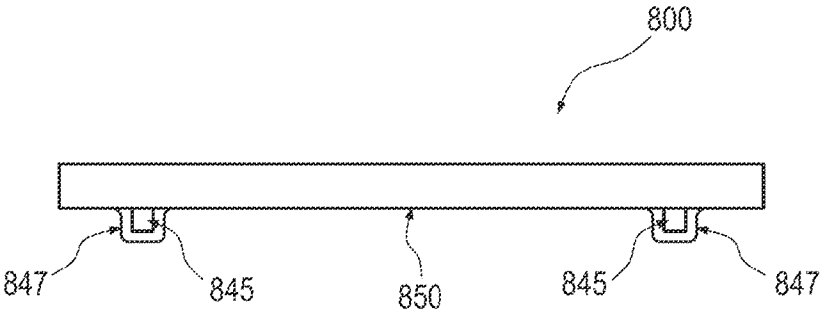
FIG. 8C is a front view of the mounting bracket and shelf system of FIGS. 8A and 8B.
Figure 8D:
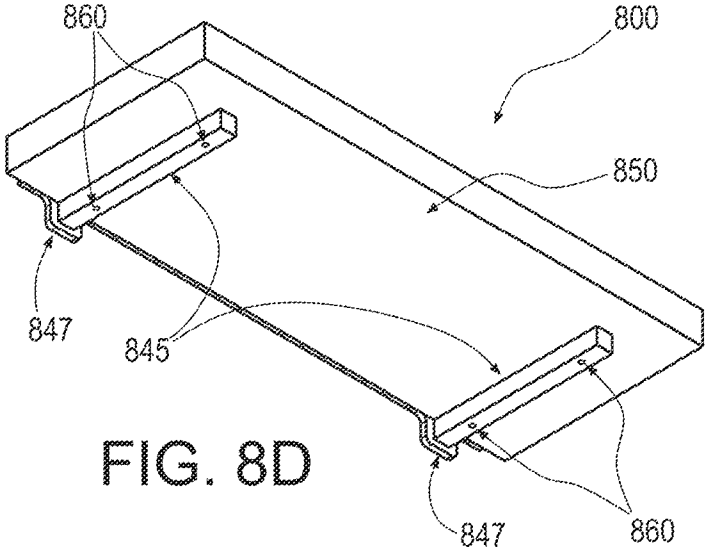
FIG. 8D is a perspective view of the mounting bracket and shelf system of FIGS. 8A-8C.
Figure 8E:
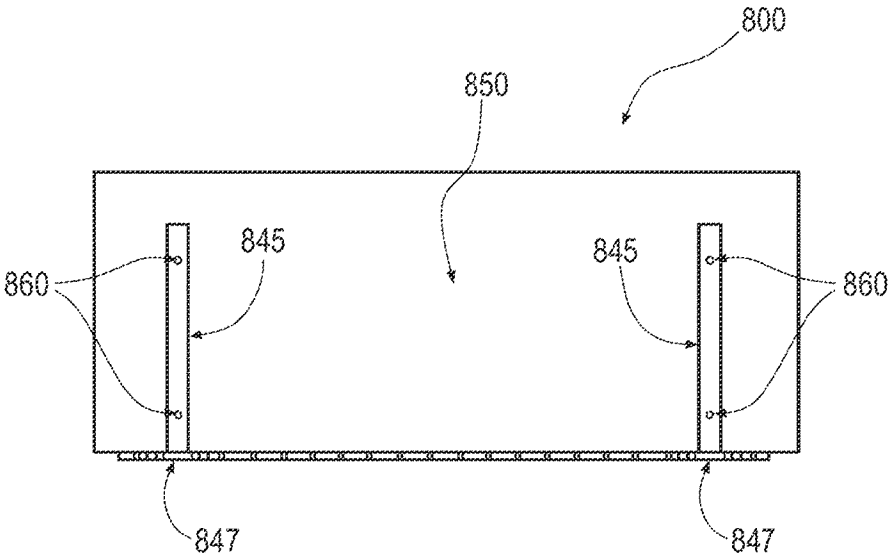
FIG. 8E is a bottom view of the mounting bracket and shelf system of FIGS. 8A-8D.

FIG. 8C shows 850 supported by rods 845 from a front view, showing the relationship of the shelf 850 and rods 845. The shelf 850 may simply rest on the rods 845, or as illustrated in FIG. 8D and FIG. 8E, it may be secured to the rods 845 through a hole 860 using a fastener such as a screw, bolt, pin, etc. FIG. 8D shows a perspective view of the bracket system 800, and FIG. 8E shows a bottom view of the system 800.

What is claimed is:

1. A bracket for mounting a shelf to a surface, the bracket comprising:

a first face for placement against the surface;

a second face configured to be placed against the shelf, the second face further including a shelf attachment comprising a plurality of rods welded to the second face and extending from the second face of the bracket and configured to support the shelf; and an edge between the first and second faces;

wherein the bracket further includes at least one hole between the first and second faces, the hole being continuous with the edge, wherein the at least one hole of the bracket has a circular shape, wherein the edge extends across the circular shape of the at least one hole to define a chord across the at least one hole, wherein the chord defines an opening of the at least one hole that is contiguous with the edge, and wherein the bracket does not include a channel connecting the at least one hole to the edge.

2. The bracket of claim 1, wherein the at least one hole is a plurality of holes.

3. The bracket of claim 2, wherein the plurality of holes comprises at least three holes that are uniformly spaced apart from each other along the edge of the bracket.

4. The bracket of claim 2, wherein the plurality of holes comprises at least three holes, and wherein a first spacing between a first pair of holes of the at least three holes is different than a second spacing between a second pair of holes of the at least three holes along the edge of the bracket.

5. The bracket of claim 1, wherein the edge is a top edge or a bottom edge of the bracket.

6. The bracket of claim 1, wherein the plurality of rods is perpendicular to the front face of the bracket.

7. The bracket of claim 1, wherein the at least one hole has a diameter at the first face that is the same as at the second face.

8. The bracket of claim 1, wherein the at least one hole has a diameter that is wider at the first face than a diameter at the second face.

9. A bracket for mounting a shelf to a surface, the bracket comprising:

a first face for placement against the surface;

a second face configured to be placed against the shelf, the second face further including a shelf attachment;

a plurality of holes between the first face and second face configured for mounting the bracket to the surface, wherein the plurality of holes is continuous along a top edge, wherein each of the plurality of holes of the bracket has a circular shape the edge extends across the circular shape of the at least one hole to define a chord across the at least one hole, wherein the chord defines an opening of the at least one hole that is contiguous with the edge, and wherein the bracket does not include a channel connecting the plurality of holes to the edge; and a plurality of rods welded to and extending from the second face of the bracket and configured to support the shelf.

10. The bracket of claim 9, wherein the bracket further includes a plurality of holes continuous along a bottom edge of the bracket.

11. The bracket of claim 9, wherein the plurality of holes is spaced along the top edge and optionally along a bottom edge of the bracket to accommodate the spacing of wall studs.

12. A bracket for mounting a shelf to a surface, the bracket comprising:

a first face for placement against the surface;

a second face configured to be placed against the shelf, the second face further including a shelf attachment comprising a plurality of rods welded to the second face and extending from the second face of the bracket and configured to support the shelf; and a plurality of holes between the first face and second face of the bracket along a top edge of the bracket configured for mounting the bracket to the surface, wherein the plurality of holes are cut into the bracket using a single cut without lifting a cutting device, wherein each hole of the plurality of holes is continuous with the edge, wherein each of the plurality of holes of the bracket has a circular shape, wherein the edge extends across the circular shape of the at least one hole to define a chord across the at least one hole, wherein the chord defines an opening of the at least one hole that is contiguous with the edge, and wherein the bracket does not include a channel connecting the plurality of holes to the edge.

13. The bracket of claim 12, wherein the bracket further includes at least one hole continuous with a lower edge of the bracket, also cut into the bracket using a single cut.

14. The bracket of claim 12, wherein the plurality of holes is spaced along the top edge and optionally along a bottom edge of the bracket to accommodate the spacing of wall studs.

15. A bracket for mounting an article of furniture to a surface, the bracket comprising:

a first face for placement against the surface;

a second face for placement against the article of furniture, the second face including a furniture attachment, wherein the furniture attachment is an upward curling lip attached to the second face to support the article of furniture;

a plurality of holes between the first face and second face and configured for mounting the bracket to the surface, wherein the plurality of holes is continuous along a top edge, wherein each of the plurality of holes of the bracket has a circular shape the edge extends across the circular shape of the at least one hole to define a chord across the at least one hole, wherein the chord defines an opening of the at least one hole that is contiguous with the edge, and wherein the bracket does not include a channel connecting the at least one hole to the edge.

16. The bracket of claim 15, wherein each of the plurality of holes has a diameter at the first face that is the same as at the second face.

17. The bracket of claim 15, wherein each of the plurality of holes has a diameter that is wider at the first face than a diameter at the second face.

* * * * *